US008328056B2

(12) United States Patent
Berdych

(10) Patent No.: US 8,328,056 B2
(45) Date of Patent: Dec. 11, 2012

(54) DEVICE FOR CARRYING SETS OF DOCUMENTS OF VARIOUS SIZES AND ASSOCIATED METHOD

(76) Inventor: David E. Berdych, Pittsburgh, PA (US)

( * ) Notice: Subject to any disclaimer, the term of this patent is extended or adjusted under 35 U.S.C. 154(b) by 2082 days.

(21) Appl. No.: 11/170,780

(22) Filed: Jun. 29, 2005

(65) Prior Publication Data

US 2006/0000857 A1 Jan. 5, 2006

Related U.S. Application Data

(60) Provisional application No. 60/584,178, filed on Jun. 30, 2004.

(51) Int. Cl.
*A45F 3/14* (2006.01)

(52) U.S. Cl. ..... 224/222; 224/219; 224/265; 220/752; 108/43

(58) Field of Classification Search ..... 224/222, 224/219, 265, 663, 678, 679, 680, 270, 272; 108/43; 119/712, 905, 174; 220/763, 757, 220/756, 755, 752; 294/25, 172
See application file for complete search history.

(56) References Cited

U.S. PATENT DOCUMENTS

| | | | | | |
|---|---|---|---|---|---|
| 2,590,732 | A | | 8/1949 | Simancik | |
| D164,269 | S | * | 8/1951 | Whittier | D19/88 |
| 2,914,222 | A | * | 11/1959 | Meshberg | 222/162 |
| 3,215,453 | A | * | 11/1965 | Malcom, Jr. | 40/546 |
| 3,232,685 | A | * | 2/1966 | Wilstein et al. | 108/23 |
| 3,443,333 | A | * | 5/1969 | Manatos | 42/1.08 |
| 3,445,046 | A | * | 5/1969 | Wilson | 224/148.5 |
| 3,754,646 | A | * | 8/1973 | Henig | 211/50 |
| 3,766,865 | A | * | 10/1973 | Cutler | 109/49.5 |
| 3,848,547 | A | * | 11/1974 | Schaefer | 109/49.5 |
| 3,875,396 | A | * | 4/1975 | Webb | 362/99 |
| 4,016,666 | A | * | 4/1977 | Finn et al. | 42/1.09 |
| D249,592 | S | * | 9/1978 | Libonati | D3/226 |
| 4,153,927 | A | * | 5/1979 | Owens | 362/99 |
| 4,243,249 | A | | 1/1981 | Goss | |
| 4,254,872 | A | | 3/1981 | Garrett | |
| 4,316,338 | A | * | 2/1982 | Mason et al. | 42/1.08 |
| 4,442,780 | A | * | 4/1984 | Child | 109/29 |
| 4,919,037 | A | * | 4/1990 | Mitchell | 89/36.05 |
| D308,542 | S | | 6/1990 | DeWitt | |
| D316,727 | S | | 5/1991 | Greenspahn | |
| 5,016,147 | A | * | 5/1991 | Voorhees | 362/99 |
| 5,088,121 | A | * | 2/1992 | Wallace | 2/160 |
| 5,088,624 | A | * | 2/1992 | Hackett et al. | 222/78 |
| 5,127,545 | A | * | 7/1992 | French | 221/102 |
| 5,323,910 | A | | 6/1994 | van de Graaf, Jr. | |
| 5,570,817 | A | * | 11/1996 | Anderson et al. | 222/153.11 |
| 5,607,090 | A | * | 3/1997 | Brown | 224/217 |
| 5,615,817 | A | * | 4/1997 | Shevers, Jr. | 224/267 |
| D379,868 | S | | 6/1997 | Robinson | |
| 5,810,220 | A | * | 9/1998 | Petersen | 224/222 |

(Continued)

*Primary Examiner* — Nathan J Newhouse
*Assistant Examiner* — Peter Helvey
(74) *Attorney, Agent, or Firm* — The Webb Law Firm

(57) ABSTRACT

A device is disclosed for carrying sets of documents of various sizes utilizing at least a document support tray supported on the forearm of a carrier by a forearm supporter secured by a single arm and hand of a carrier such that the documents may easily be delivered utilizing the free arm of the carrier to selectively pick from one of the stacks made available through the device. The device also includes a holder to secure an animal repellent container. The device also permits a novel method of delivering mail whereby the carrier may have free use of the hand and arm opposite to that engaged by the device.

34 Claims, 9 Drawing Sheets

U.S. PATENT DOCUMENTS

| | | | | |
|---|---|---|---|---|
| 5,836,488 | A | 11/1998 | Priestley | |
| 5,845,826 | A | 12/1998 | Nguyen | |
| 5,955,170 | A | 9/1999 | Davis et al. | |
| 5,961,003 | A * | 10/1999 | Coryell | 222/175 |
| D453,073 | S * | 1/2002 | Kelly, Sr. | D3/315 |
| 6,520,394 | B2 * | 2/2003 | Ulibarri | 224/627 |
| 6,662,733 | B1 * | 12/2003 | Scott | 108/43 |
| 6,726,070 | B2 * | 4/2004 | Lautner | 224/221 |
| 6,734,842 | B2 * | 5/2004 | Woodmansee et al. | 345/169 |
| 7,146,899 | B2 * | 12/2006 | Imblum et al. | 89/36.01 |
| D537,120 | S * | 2/2007 | Mandel | D19/88 |
| 7,644,839 | B2 * | 1/2010 | McNulty, Jr. | 222/79 |
| 7,712,408 | B1 * | 5/2010 | Copeland et al. | 89/36.01 |
| 2002/0011020 | A1 * | 1/2002 | Nelson et al. | 43/107 |
| 2004/0046669 | A1 * | 3/2004 | Chiapperini | 340/574 |
| 2005/0053769 | A1 * | 3/2005 | Imblum et al. | 428/170 |

* cited by examiner

DEVICE FOR CARRYING SETS OF DOCUMENTS OF VARIOUS SIZES AND ASSOCIATED METHOD

CROSS-REFERENCE TO RELATED APPLICATIONS

This application claims the benefit of U.S. Provisional Application No. 60/584,178 filed Jun. 30, 2004.

BACKGROUND OF THE INVENTION

1. Field of the Invention

This invention is directed to a document handling device and, more particularly, to a document handling device adapted to conveniently hold different types of mail that a mail carrier must distribute throughout the course of his or her route. The present device functions as a dispenser which allows the contents to be taken out and used in convenient or prescribed amounts.

2. Description of Related Art

When documents are provided to a mail carrier from the United States Postal Service, they are essentially divided into three groups. Direct point sequence bar coded mail (DPS mail) is machine sorted and provided to carriers in presorted bundles for specific addresses. Mail that is not able to be sorted by the sorting machines is hand sorted to the level of individual mail carrier routes and the individual mail carriers must then further sort this mail for specific addresses. Finally, mail carriers must deliver mass mailing literature that is uniformly distributed to each address. Given not only the large volume of mail a typical mail carrier must deliver, but furthermore, the variety of types of mail in separate bundles and the need to collate the bundles on the fly prior to delivery, it becomes very challenging for a mail carrier to efficiently perform the mail delivery tasks inherent with each route.

DPS mail sorting machines have dramatically cut in-office labor costs but have transferred additional duties to the carrier. A device and method is needed to enhance the efficiency of mail distribution for a mail carrier along the mail carrier route.

In the course of delivering mail over a postal route, a mail carrier typically encounters various animals, of which the most common and most threatening are dogs. Although mail carriers are supplied with an animal repellant in the form of a container with a spray repellant, the container is often knocked loose and lost unbeknownst to the carrier. If the container has not been lost previously during the day, retrieving this container, aiming the spray at the dog, and activating the spray all consume valuable time when the carrier is under attack and require the carrier to focus more on these actions than on the threatening dog. Additionally, handfuls of mail may be dropped and the satchel may need to be removed for defensive purposes. The satchel may be very heavy and difficult to maneuver and picking up dropped mail is very time consuming. As a result, a device is also needed to make it easier and faster for the mail carrier to activate the repellant spray when under attack or merely threatened with an attack.

SUMMARY OF THE INVENTION

One embodiment of the subject invention is directed to a device for carrying sets of documents of various sizes in such a manner to permit convenient access to the topmost documents and rapid, coordinated distribution of the desired documents, the device adapted to be supported between a carrier's forearm and his body, the device having a document support tray for accepting and retaining documents. The tray has first and second ends, first and second edges and a top and a bottom surface, wherein a longitudinal axis extends between the first and the second end. The device also has a forearm supporter attached to the tray, wherein the forearm supporter is adapted to at least partially engage the forearm of a carrier and wherein the forearm supporter is positioned adjacent to the bottom surface of the tray.

Another embodiment of the subject invention is directed to a method of delivering mail made up of documents of various sizes using a document holder. The holder has a document support tray for accepting and retaining documents, a document receptacle for accepting other documents such as mass mailing literature that must be folded or rolled, for the most convenient delivery, and a forearm supporter attached to the tray, wherein the forearm supporter is positioned adjacent to the bottom surface of the tray and is adapted to at least partially enclose the forearm of a carrier and wherein the document receptacle is attached to the tray and positioned adjacent to the top surface of the tray. The method comprises the steps of:

a) mounting documents upon the top surface of the tray;

b) holding other documents in the hand associated with the document holder; and c) selectively removing for delivery mail for a particular address from the document holder and the opposing hand.

DETAILED DESCRIPTION OF THE INVENTION

Figure 1:
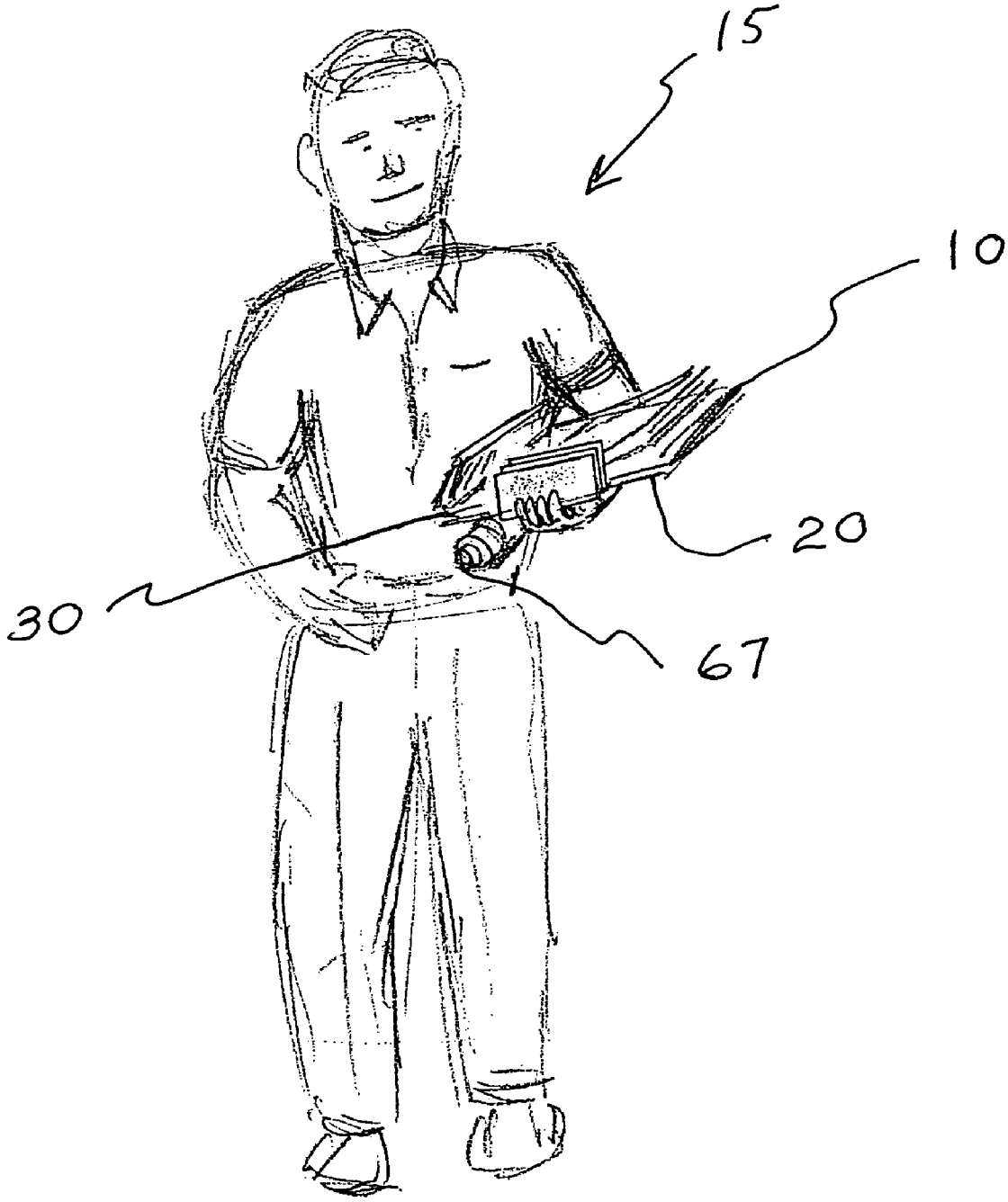
FIG. 1 is a mail carrier holding one embodiment of the device in accordance with the subject application.
Figure 4:
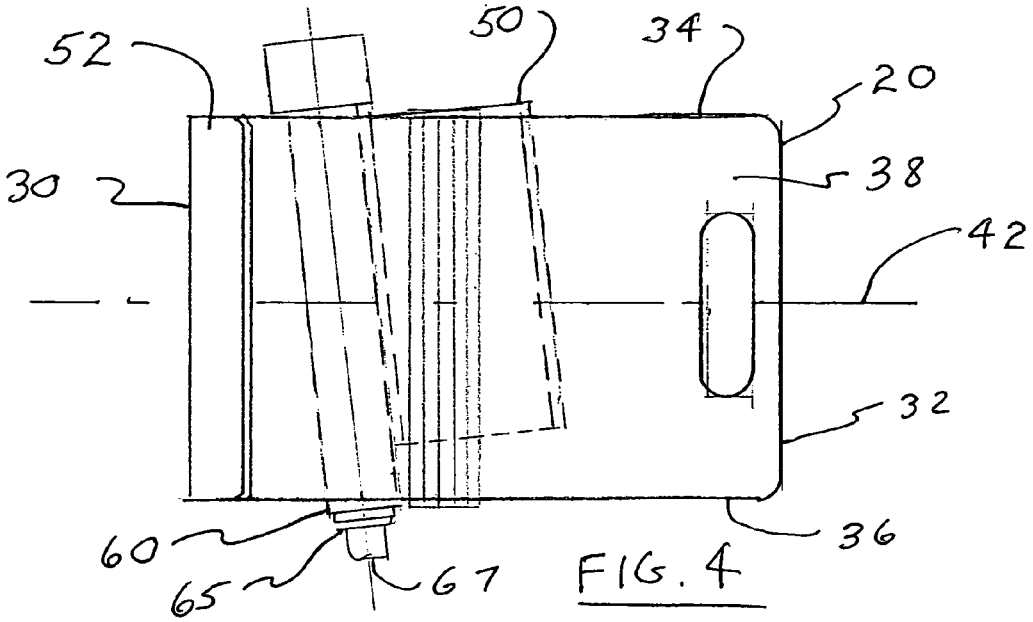
FIG. 4 is a top view of the device illustrated in FIG. 1.
Figure 5:
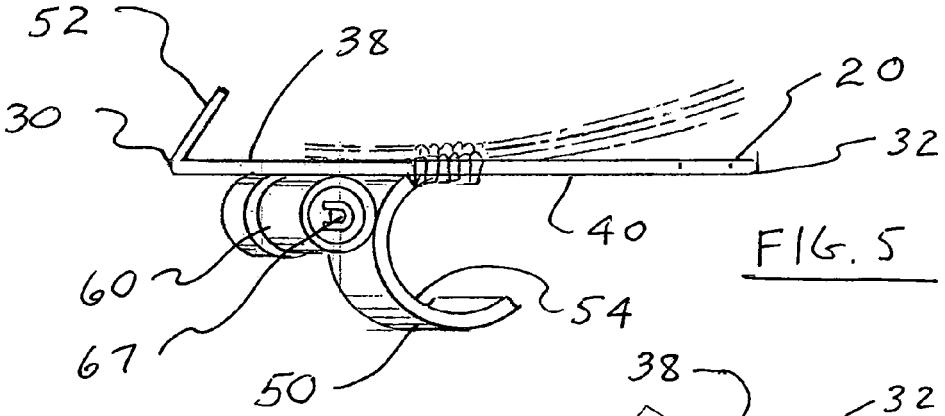
FIG. 5 is a side view of the device illustrated in FIG. 1.
Figure 2:
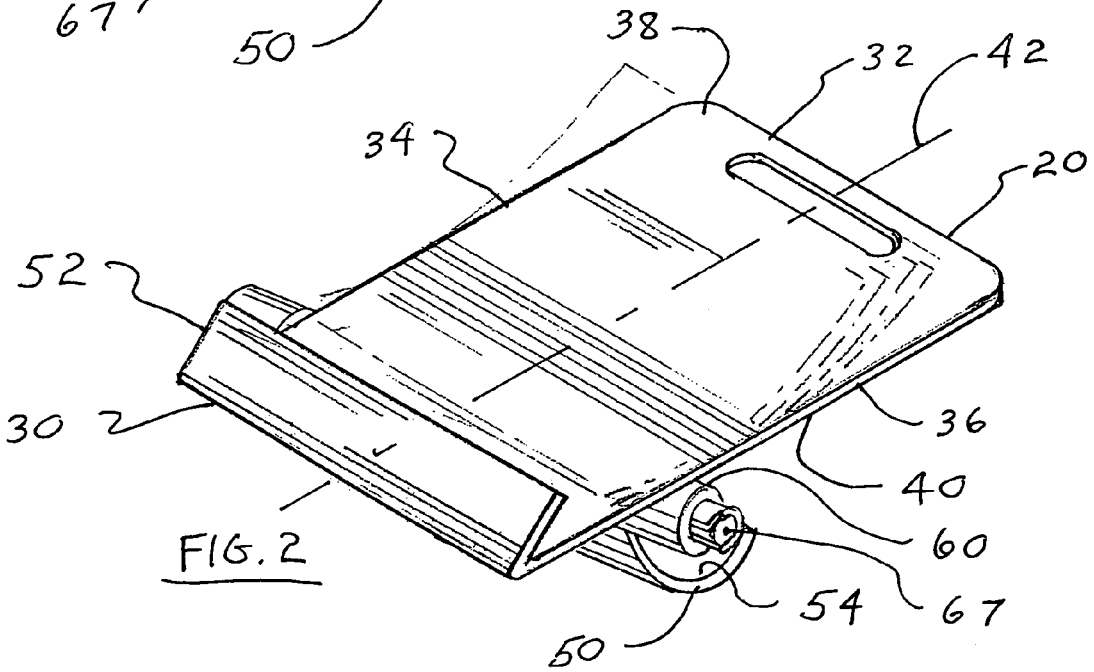
FIGS. 2 and 3 are perspective views of the device illustrated in FIG. 1.
Figure 3:
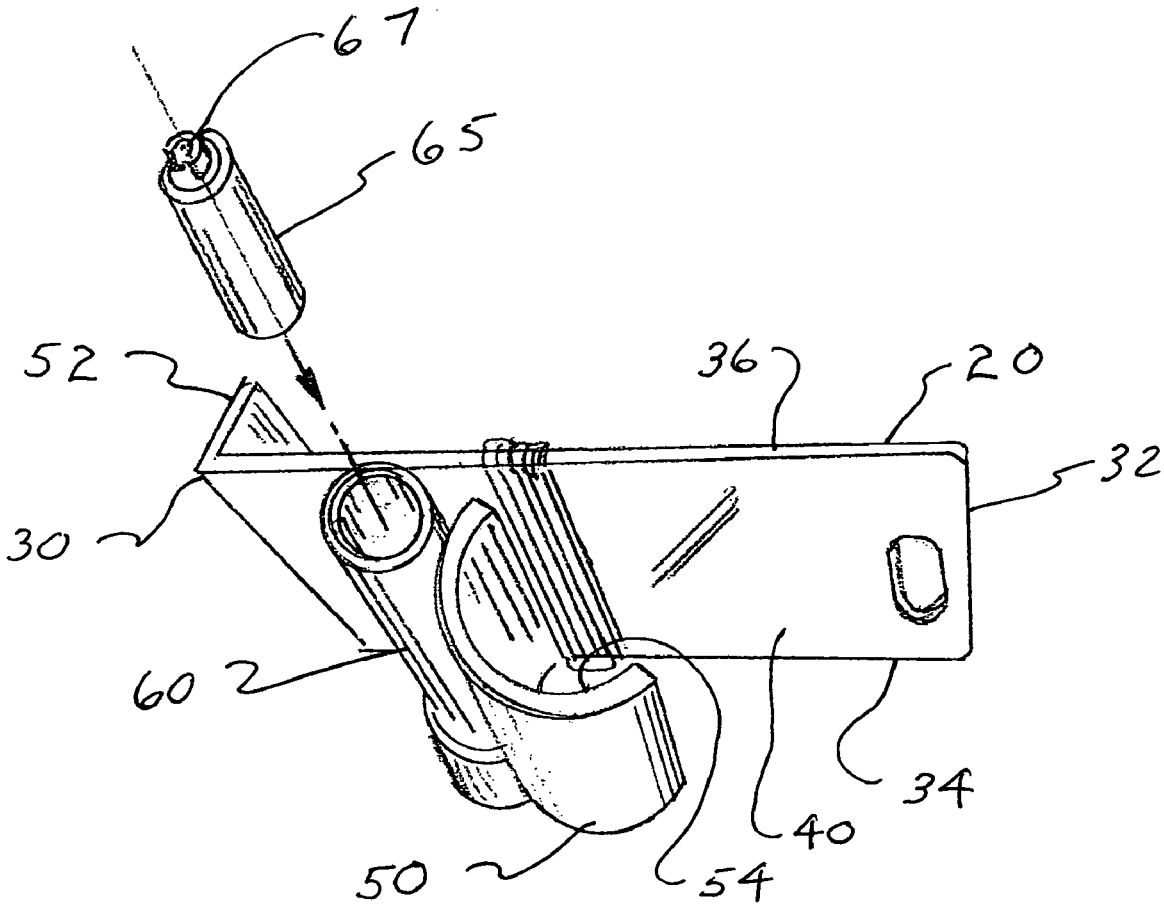

FIG. 1 illustrates the device 10 in accordance with a first embodiment of the subject invention wherein the device 10 is held by a carrier 15. The device 10 is adapted to be supported between the carrier's inner forearm and his or her body. The device 10 is further illustrated in FIGS. 2-5 and, unless specified otherwise, the discussion hereinafter will be directed to those figures for this embodiment.

The device 10 is used for carrying documents of various sizes in such a manner to permit convenient access to the top most documents and rapid coordinated distribution of the desired documents. The device 10 is comprised of a document support tray 20 for accepting and retaining documents 25 (shown in phantom). The tray 20 has a first end 30, and opposing second end 32, a first edge 34 and an opposing second edge 36, a top surface 38 and a bottom surface 40. A longitudinal axis 42 extends along the length of the tray 20 between the first end 30 and the second end 32.

A forearm supporter 50 is also attached to the tray 20. The forearm supporter 50 is adapted to at least partially engage the forearm of a carrier 15. The forearm supporter 50 is positioned adjacent to the bottom surface 40 of the tray 20. Additionally, the tray 20 has a ledge 52 positioned at the first end 30 of the tray 20.

The forearm supporter 50 is mounted to the bottom surface 40 of the tray 20 and, briefly referring to FIG. 1, the tray 20 is oriented to receive the forearm of the carrier when the tray's first end 30 rests against the torso of the carrier. Returning to FIGS. 2-5, the forearm supporter 50 may be arcuate with the concave side 54 facing the bottom surface 40 of the tray 20. As a result of this design when held by a carrier, the natural range of motion of a carrier's forearm tends to urge the device 10 against the body of the carrier 15.

Carriers are provided with animal repellant. A typical animal repellant provided to carriers to deter animal attacks is a canister having a spray nozzle so that liquid repellant may be directed from a distance toward an animal. The device 10 in accordance with the subject invention may include a repellant holder 60 attached to the tray 20 for holding a repellant container 65 with the spray nozzle 67 of the repellant container extending therefrom. The repellant holder 60 may be in the form of a tube mounted upon the tray 20 and adapted to receive a cylindrical spray repellant container 65 and to direct the container spray away from the bottom surface 40 of the tray 20. By doing so and once again briefly referring to FIG. 1, with the repellant spray directed downwardly from the tray 20, the carrier may move his or her arm to reorient the tray 20 thereby reorienting the spray nozzle 67 for dispersion in a different direction. The tube 60 may be positioned proximate to the expected location of the fingers of the carrier 15 for easy access to activate the spray repellant. The tube 60 may be mounted to the bottom surface 40 of the tray 20 near the first end 30 of the tray 20. Additionally, the tube 60 may be oriented in the direction generally perpendicular to the longitudinal axis 42 of the tray 20.

Figure 6:
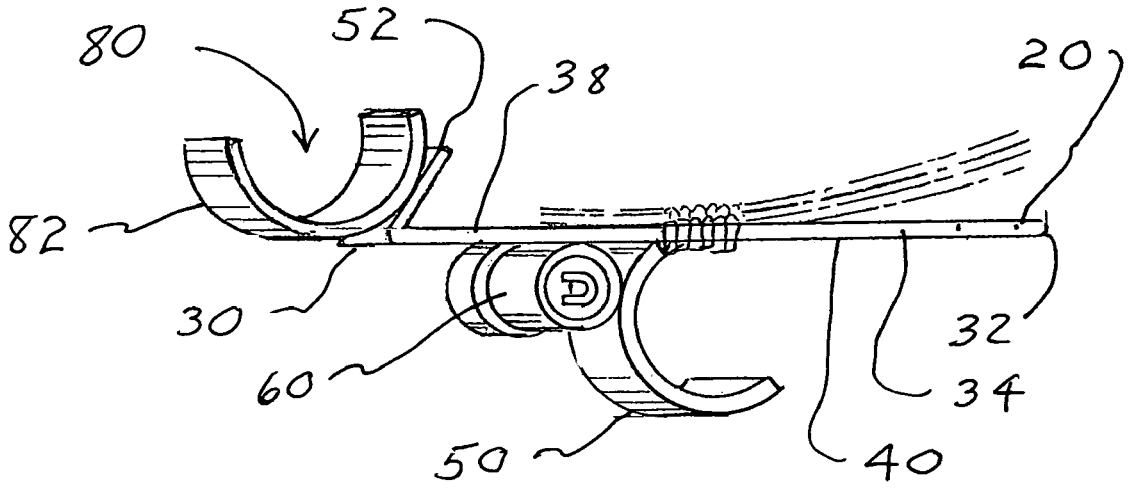
FIG. 6 is a side view of a second embodiment of a device in accordance with the subject invention.
Figure 7:
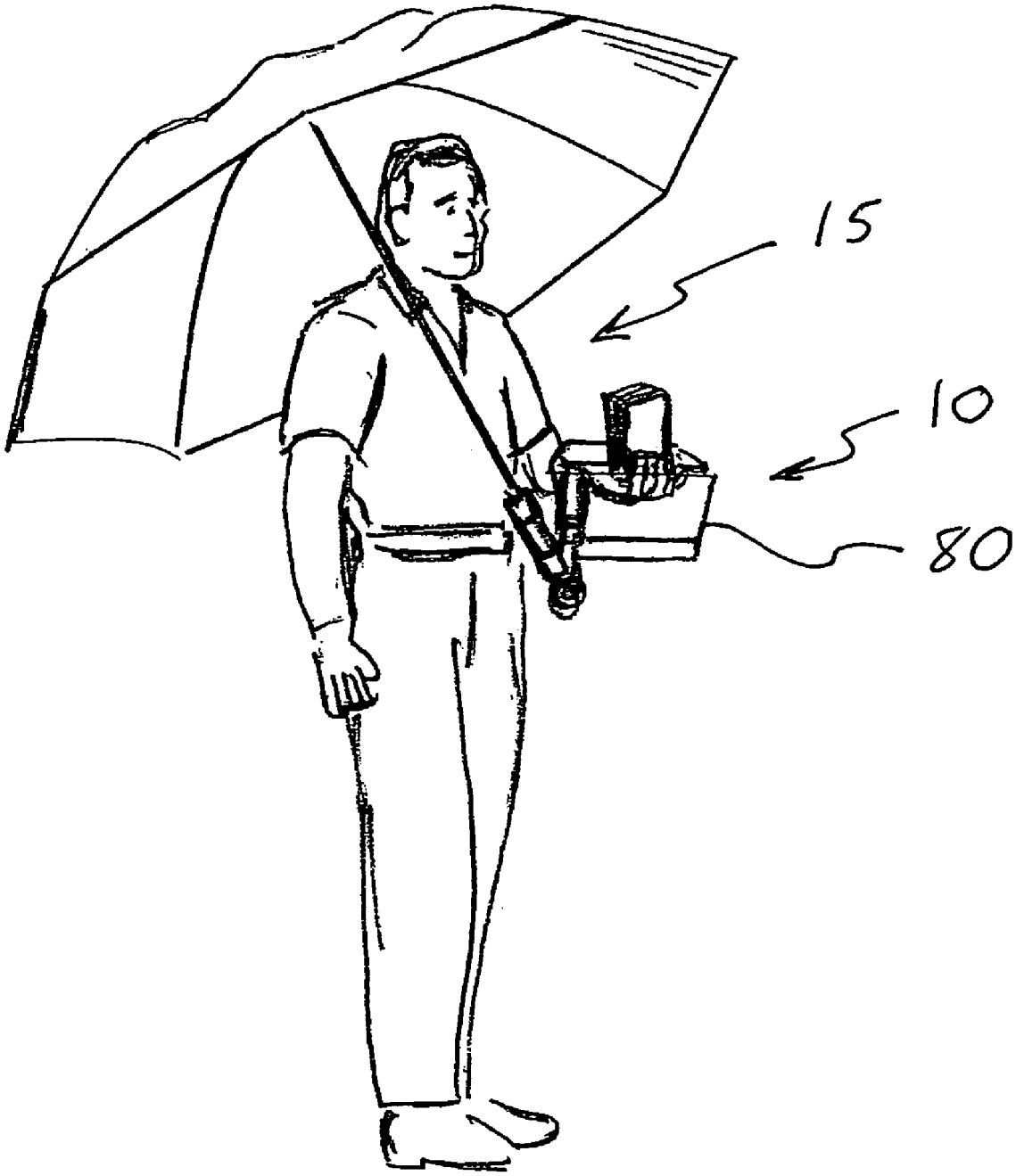
FIG. 7 is an illustration of a carrier holding a device in accordance with the third embodiment of the subject invention.

As a further enhancement to the subject invention, as illustrated in FIG. 6, the device 10 may include a document receptacle 80 extending at least partially below the bottom surface 40 of the tray 20. As illustrated in FIG. 6, the document receptacle 80 is a sleeve 82 located adjacent to and extending away from the first end 30 of the tray 20. Other designs are possible to provide a document receptacle 80, which is not in the form of a sleeve 82.

FIGS. 7-12 illustrate a device 10 in accordance with a third embodiment of the subject invention whereby the document receptacle 80 is a basket 84 suspended beneath the tray 20. The embodiment illustrated in FIGS. 7-12 includes additional accessories which will also be described hereinafter.

Figure 12:
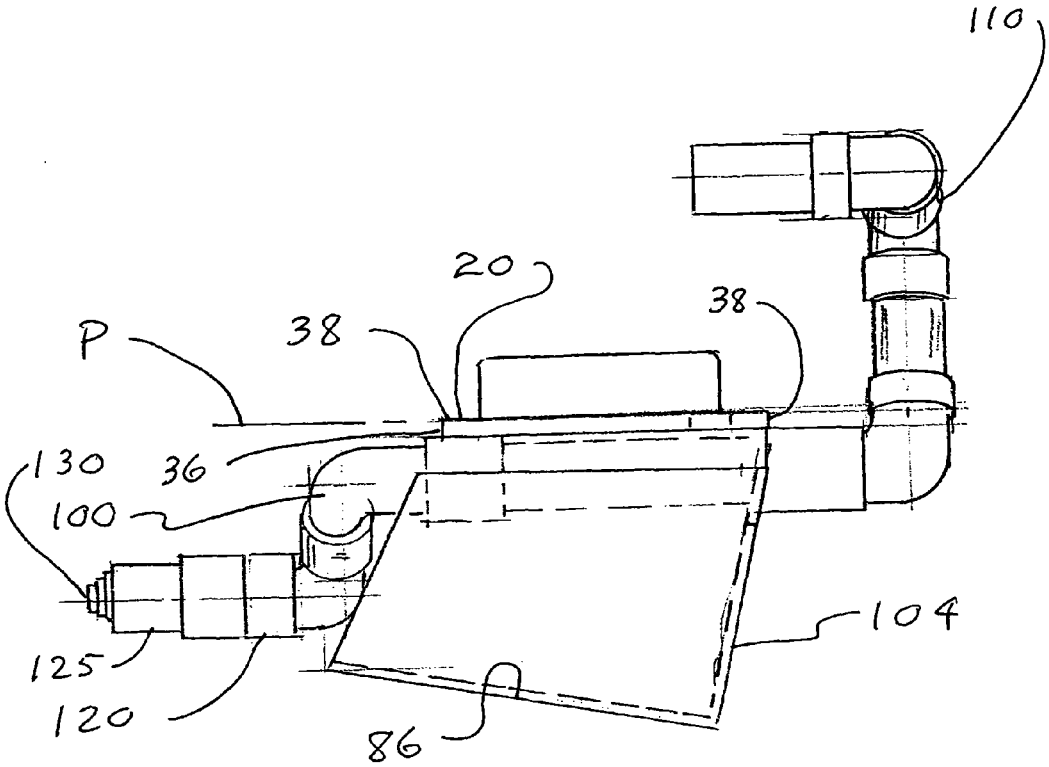
FIG. 12 is a side view of the device illustrated in FIG. 7.

With respect to the basket 84 and directing attention to FIG. 12, the top surface 38 of the tray 20 defines a plane P and the basket 84 has a top surface 86 which is inclined downwardly from the second edge 36 of the tray 20 to the first edge 34 of the tray 20 to retain documents 88 (FIG. 9) therein when the device 10 is held by a carrier 15.

Figure 9:
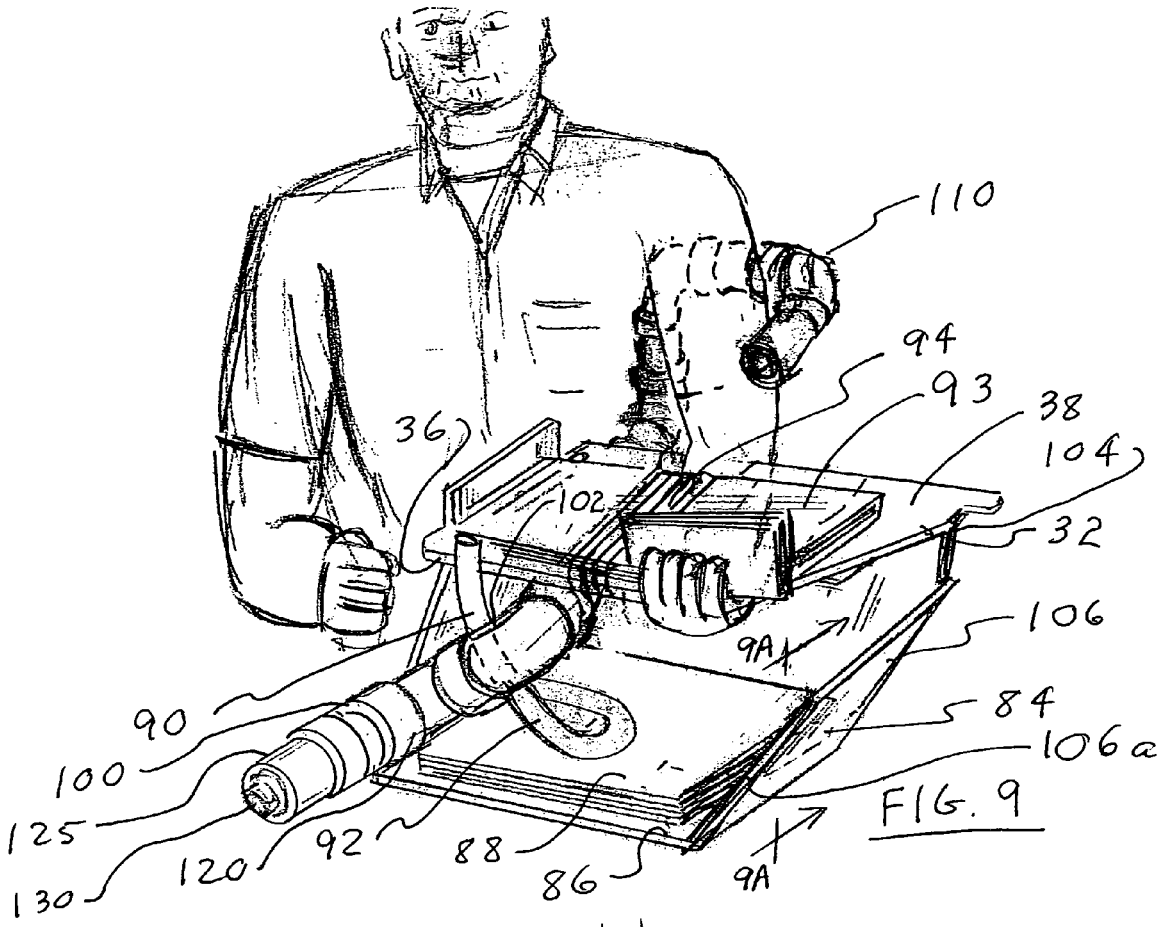
FIG. 9 is a perspective view of the device illustrated in FIG. 7 held by a mail carrier and populated with mail but without an umbrella attachment.
Figure 11:
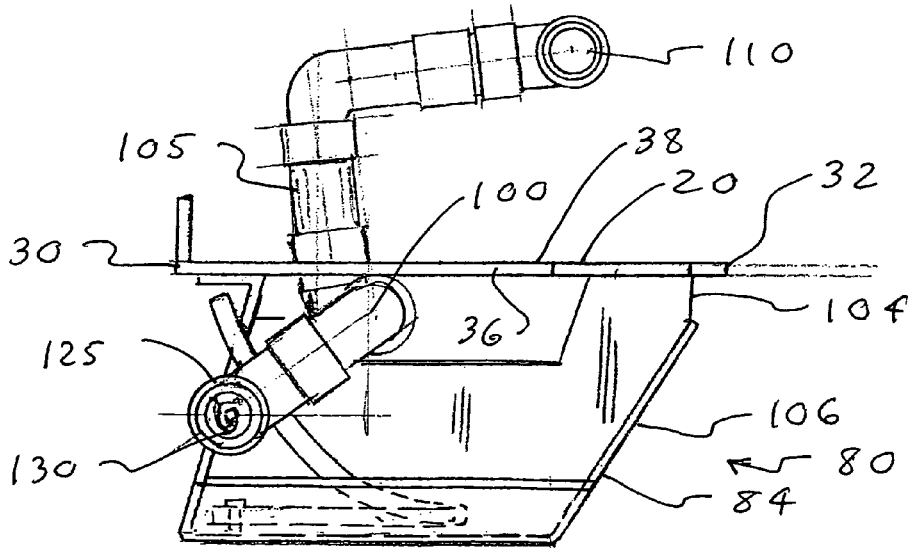
FIG. 11 is a front view of the device illustrated in FIG. 7.

It should be appreciated from inspection of FIGS. 1 and 9 that the device 10 provides to the carrier 15 complete freedom of the opposite hand and arm not associated with the device 10. This is a significant advantage over prior art delivery techniques, which often times engage both hands of the carrier thereby reducing efficiency.

The arrangement of documents in any particular location on the subject device 10, whether it is the document support tray 20, or the document receptacle 80, is at the discretion of the carrier 15 and may be arranged in any fashion desired by the carrier. However, two sets of documents may easily be accommodated through the device 10 and furthermore, a third set of documents may be secured with the carrier's hand.

In one arrangement a carrier 15 may support non-presorted mail 93 directed to specific addresses within the document support tray 20 where it may be selectively removed for specific addresses. The mass mailing literature, otherwise called Advos, may rest within the document receptacle 80. These unaddressed documents do not need to be examined before removal for each delivery to each address, and as a result, may be conveniently carried out of view, beneath the non-presorted mail. Finally, the DPS mail, which as previously mentioned is the Direct Point Sequence bar-coded mail, that is provided to carriers in bundles, pre-sorted specifically by address, may be held in the carrier's hand such that now the entire content of documents to be delivered is retained with the device 10 and secured by a single hand. Because the device 10 is secured to the forearm of the carrier, as a result of gravity the forearm tends to pivot against the body of the carrier 15. As a result, a significant portion of the weight of the documents and device 10 is supported largely by the carrier's shoulder and does not require the exertion of significant muscular effort, which over a long term would be fatiguing.

The non-presorted mail 93 is illustrated on the tray 20 in FIG. 9 secured by elastic bands 94. The same arrangement exists for the documents on the tray 20 in FIGS. 2-5. Each bundle of non-presorted mail 93 is kept together by an elastic band 94 and as a bundle is dispersed for delivery, the elastic band 94 may remain around the tray 20 to support the remaining bundles.

Directing attention to FIG. 9, in order to secure the documents 88 within the basket 84 the device 10 further includes a resilient member 90 which is biased against the top surface 86 of the basket 84 to retain documents 88 therein. The resilient member 90 may be comprised of a flexible hose secured to a frame 100 used to support the tray 20 and the basket 84. As illustrated in FIG. 9, the resilient member 90 is a flexible tube 92, which may be selectively passed through a bore 102 extending through the frame 100, wherein the tube 92 is frictionally retained within the bore 102. As an example, by pushing the tube 92 through the bore 102 the tube 92 is urged against the top surface 86 of the documents 88 thereby minimizing slippage of the documents 88 and retaining them within the basket 84. Multiple bores 102 may be used to permit the tube 92 to be repositioned to stabilize and secure small coupon books within the Advos at the point where the Advo is grabbed for delivery. The tube 92 also applies pressure to the open end of the documents in a manner designed to insure that the topmost document's closed end extends farther away from the carrier's torso than the document below it. The orientation of the flexible tube 92 may be adjusted to provide more or less force on the top of the documents within the basket 84. This makes blind retrieval of the topmost document easier since its edge will be the easiest edge in the stack to get a grip on. To further retain documents 88 within the basket 84, the basket 84 has a wall 104 toward the first edge 34 of the tray 20. As illustrated in FIG. 12 and as previously discussed, the top surface 86 of the basket 84 is inclined and this acts to urge the documents against the wall 104.

Figure 9A:
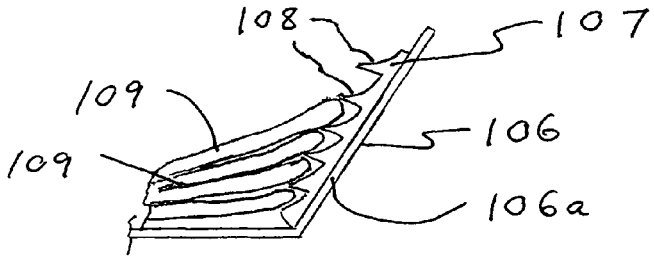
FIG. 9A is a partial section view along arrows "9A-9A" in FIG. 9.

Additionally, the basket 84 may have a side wall 106 located toward the second end 32 of the tray 20 to further retain documents within the basket 84. As illustrated in FIG. 9A, the side wall 106 may have a document separator 107 made up of a plurality of stepped supports 108, wherein the stepped supports 108 are spaced to space apart documents 109 placed within the basket 84 for ease of removal of such documents 109. The documents 109 also extend beyond the front face 106A of the side wall 106 to make removal easier.

The embodiment of the device 10 illustrated in FIGS. 1-5 included a forearm supporter 50 which engages the forearm of a carrier 15 and as a result, the weight of the device 10 and its contents was transmitted at one location, to the forearm of the carrier. Additionally, the device 10 contacted the torso of the carrier along the first end 30 of the tray 20 and, therefore, the weight of the device was also transmitted to the torso of the carrier 15 since the first end 30 rested against the carrier's torso.

The embodiment illustrated in FIGS. 7-12 includes a frame 100 used in lieu of the forearm supporter 50 previously discussed.

In particular, and with attention to FIG. 9, as an overview a frame 100 may be used to support the tray 20 and the basket 84, but furthermore, engage the arm of the carrier such that the frame captures the arm of the carrier to distribute the weight of the device to the carrier's forearm, upper arm and as before, to the carrier's torso.

Figure 8:
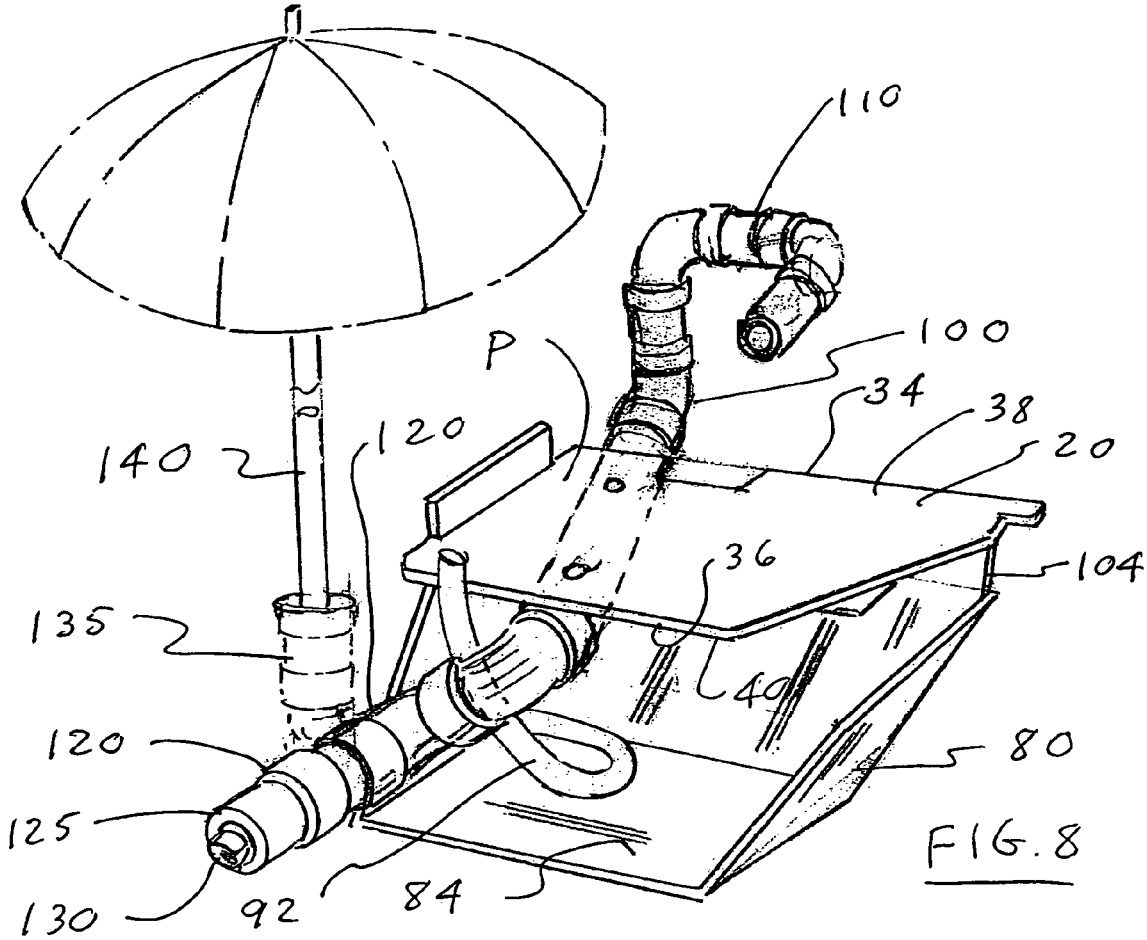
FIG. 8 is a perspective view of the device illustrated in FIG. 7.
Figure 10:
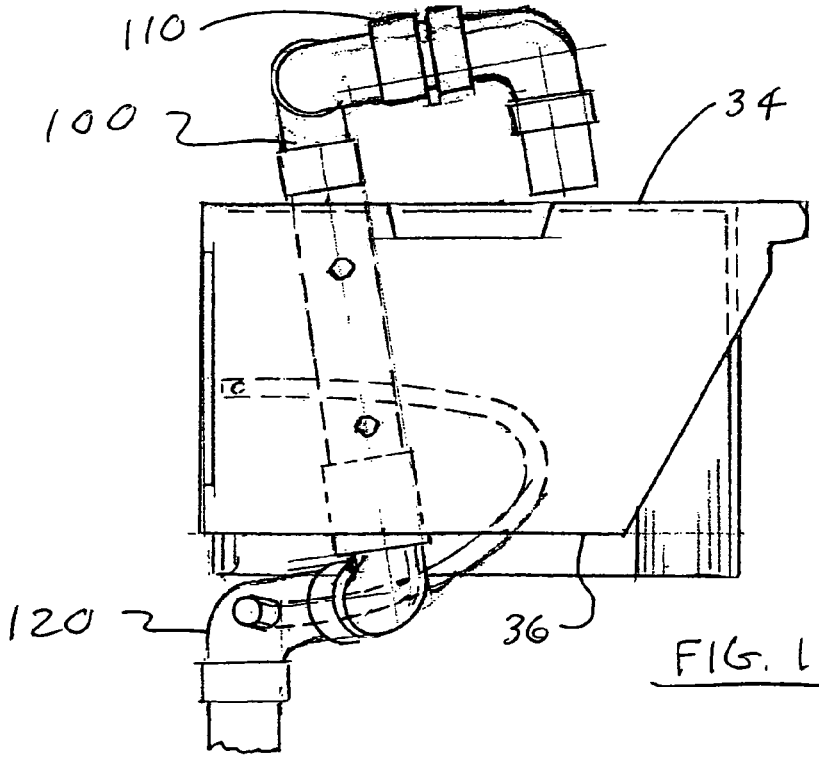
FIG. 10 is a top view of the device illustrated in FIG. 7.

In particular, and with attention directed to FIG. 8 and FIG. 10, the frame 100 extends beyond the first edge 34 of the tray and beyond the top surface (FIG. 11) of the tray 20. The frame 100 as a first member 105 (FIG. 11) with a shape extending away from the top surface 38 of the tray 20 and then extending in the direction from the first end 30 to the second end 32 of the tray. In such a fashion the first member 105 of the tray 100 is adapted to engage the arm of a carrier holding the device 10. The first support member 105 and the tray 20 are positioned relative to one another to engage the carrier's arm to transfer part or all of the weight of the device 10, with documents therein, to the carrier's arm. This arrangement is illustrated in FIG. 9.

The frame 100 may further include a second support member 110 which extends from the first support member 105. The second support member 110 is adapted to enclose the arm of a carrier between the second support member 110 and the first support member 105 as illustrated in FIG. 9.

Figure 13:
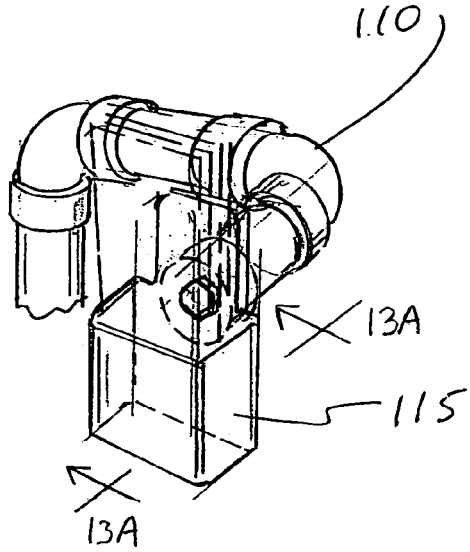
FIG. 13 is a perspective view illustrating the option of attaching document holders to the device illustrated in FIG. 7.
Figure 13A:
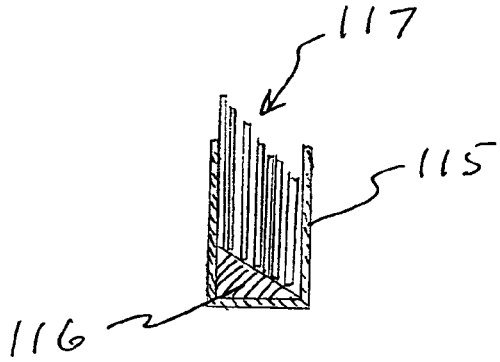
FIG. 13A is a partial cross-section along lines "13A-13A" in FIG. 13.

It should be noted that the second support member 110 may be comprised of a hollow tube and as illustrated in FIG. 13, it is possible to mount an overflow document holder 115 to the second support member 110. As illustrated in FIG. 13A, the overflow document holder 115 may have a document separator 116 therein to space apart by height, documents 117 placed within the holder 115. The document separator 116 may be angled, as illustrated in FIG. 13A, or may be stepped in the same fashion illustrated in FIG. 9A for document separator 107.

The frame 100 may extend away from the opposite side of the tray also and may include a third support member 120 beyond the second edge 36 of the tray 20. The third support member 120 is oriented in a direction generally perpendicular to the longitudinal axis 42 of the tray 10. The third support member 120 acts to function as a repellent holder 125 containing therein a repellant container 130. Wherein the repellant container 130 may be oriented in a fashion similarly discussed with respect to the first embodiment of the subject invention.

Figure 14:
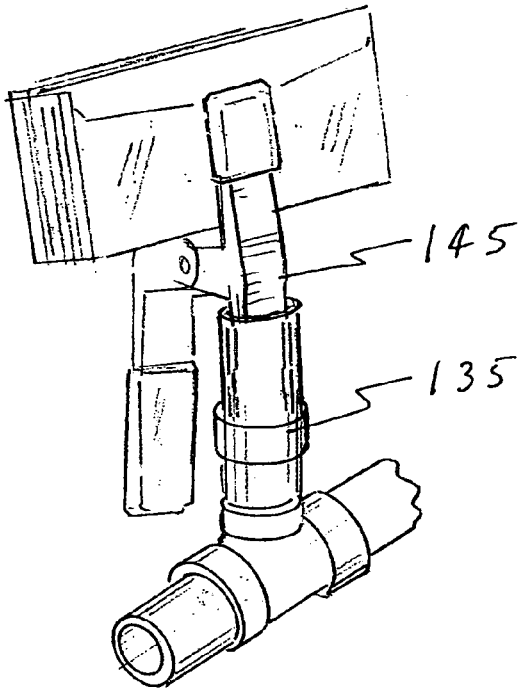
FIG. 14 is a perspective view illustrating the option of attaching a clamp to the device illustrated in FIG. 7.

As illustrated in FIG. 8, the frame 100 may include a fourth support member 135 extending from the third support member 120 in a direction from the bottom surface 40 of the tray 20 and generally perpendicular to the plane P of the top surface 38 of the tray 20. The fourth support member 135 may be used to support an umbrella 140 (FIG. 8) or in the alternative, as illustrated in FIG. 14, may be used to support a clamp 145 or an additional overflow document holder (not shown) similar to an overflow document holder 115 illustrated in FIG. 13.

The overflow document holder 115 (FIG. 9) and the overflow document holder (not shown) that could be mounted to the fourth support member 135 (FIG. 13), may be mounted in an orientation most suitable for ease of access by the carrier 15.

In general, the position of the forearm supporter 50 or the frame 100 may be adjusted upon the tray 20 in a lateral and rotational fashion to accommodate the orientation and size of the forearms of different carriers.

The subject invention is also directed to a method of delivering mail made up of documents of various sizes using a device 10 having a document support tray 20 for accepting and retaining documents, a document receptacle for accepting other documents such as mass mailing literature that must be folded or rolled, and a forearm supporter 50 attached to the tray 20, wherein the forearm supporter 50 is positioned adjacent to the bottom surface 40 of the tray 20 and is adapted to at least partially enclose the forearm of a carrier 15. The document receptacle 80 is attached to the tray 20 and positioned adjacent to the top surface 38 of the tray 20. Directing attention to FIG. 1, the method is comprised of the steps of mounting the documents upon the top surface 38 of the tray 20 while holding other documents in the hand associated with the device 10. The method is then comprised of selectively removing for delivery, mail for a particular address from the document support tray 20 and from the hand of the carrier 15.

Briefly directing attention to FIG. 6, the method may further include the step of positioning folded or rolled documents into a document receptacle such as the sleeve 82 (FIG. 6) or the basket 84 (FIG. 8) and then additionally selectively removing documents from this document receptacle 80.

It should be appreciated that the relative location of the elements of the device 10 are intended to permit the carrier 15 to blindly pull documents from different locations and to activate the animal repellant without the need to first locate the repellant container visually.

The frame 100 has been shown as hollow pipe. It should be understood that this arrangement is illustrative and that other structural elements may be used in place of such pipe.

The device in accordance with the subject invention provides an apparatus and method whereby the efficiency and the safety of mail handlers may be significantly improved.

This invention has been described with reference to the preferred embodiments. Obvious modifications and alterations will occur to others upon reading and understanding the proceeding detailed descriptions. It is intended that the invention be construed as including all such modification and alterations.

The invention claimed is:

1. A device for carrying sets of documents of various sizes in such a manner to permit convenient access to the topmost documents and rapid, coordinated distribution of the desired documents, the device adapted to be supported between a carrier's forearm and his body, the device comprising:

a document support tray for accepting and retaining documents, wherein the tray has first and second ends, first and second edges, and a top and a bottom surface, wherein a longitudinal axis extends between the first and the second end;

an arm support attached to the tray, wherein the arm support is adapted to at least partially engage the arm of a carrier and wherein the arm support is positioned adjacent to the bottom surface of the tray;

a repellant holder attached to the bottom surface of the tray for holding a repellant container, wherein the repellant holder is oriented in a direction generally perpendicular to the longitudinal axis of the tray and wherein the repellant holder extends beyond the second edge of the tray; and a repellant container mounted within the repellant holder, wherein the container has a spray nozzle extending therefrom and wherein the repellant container and spray nozzle extend from the repellant holder beyond the second edge of the document support tray.

2. A device for carrying sets of documents of various sizes in such a manner to permit convenient access to the topmost documents and rapid, coordinated distribution of the desired documents, the device adapted to be supported between a carrier's forearm and his body, the device comprising:

a document support tray for accepting and retaining documents, wherein the tray has first and second ends, first and second edges and a top and a bottom surface, wherein a longitudinal axis extends between the first and the second end;

an arm support attached to the tray, wherein the arm support is adapted to only partially engage the arm of a carrier and wherein the arm support is positioned adjacent to the bottom surface of the tray;

a repellant holder attached to the bottom surface of the tray for holding a repellant container, wherein the repellant holder is oriented in a direction generally perpendicular to the longitudinal axis of the tray and wherein the repellant holder extends beyond the second edge of the tray; and a repellant container mounted within the repellant holder, wherein the container has a spray nozzle extending therefrom and wherein the spray nozzle extends from the repellant holder and beyond the second edge of the document support tray.

3. The device according to claim 1, wherein the tray has a ledge extending from the top surface to support documents placed upon the tray.

4. The device according to claim 2, wherein the ledge is positioned at the first end of the tray.

5. The device according to claim 1, wherein the arm support is a forearm supporter mounted to the bottom surface of the tray and oriented to receive the forearm of the carrier when the tray first end rests against the torso of the carrier.

6. The device according to claim 5, wherein the forearm supporter is arcuate with the concave side facing the bottom surface of the tray.

7. The device according to claim 1, wherein the repellant holder is a tube mounted upon the tray and adapted to receive a cylindrical spray repellant container and to direct the container spray away from the tray bottom surface.

8. The device according to claim 7, wherein the tube is mounted to the bottom surface of the tray near the tray first end.

9. The device according to claim 7, wherein the tube is positioned proximate to the expected location of the fingers of the carrier's hand for easy access to activate the spray repellant.

10. The device according to claim 1, further including a document receptacle extending at least partially below the bottom surface of the tray.

11. The device according to claim 10, wherein the document receptacle is a sleeve located adjacent to and extending away from the first end of the tray.

12. The device according to claim 10, wherein the document receptacle is a basket suspended beneath the tray.

13. The device according to claim 12, wherein the top surface of the tray defines a plane and the basket has a top surface which is inclined downwardly from the second edge of the tray to the first edge of the tray to retain documents when the device is held by a carrier.

14. The device according to claim 13, further including a resilient member biased against the top surface of the basket to retain documents therein.

15. The device according to claim 13, wherein the basket has a back wall toward the first edge of the tray to retain documents therein.

16. The device according to claim 12, wherein the basket has a side wall toward the tray second end to retain documents within the basket.

17. The device according to claim 1, wherein the arm support is a frame attached to the tray and adapted to receive and rest against the arm of a carrier.

18. The device according to claim 17, wherein the frame extends beyond the first edge of the tray and beyond the top surface of the tray, wherein the frame has a first support member with a shape extending away from the top surface of the tray and then extending in the direction from the first end to the second end of the tray and adapted to engage the arm of a carrier holding the device.

19. The device according to claim 18, wherein the frame further includes a second support member extending from the first support member and adapted to enclose the arm of a carrier between the second support member and the first support member.

20. The device according to claim 19, wherein the first support member and the tray are positioned relative to one another to engage the carrier's arm to transfer part or all of the weight of the device to the carrier's arm.

21. The device according to claim 19, wherein the second support member is adapted to receive a document holder.

22. The device according to claim 21, wherein the document holder has an angled separator therein to space apart at by increasing height different documents placed within the holder.

23. A device for carrying sets of documents of various sizes in such a manner to permit convenient access to the topmost documents and rapid, coordinated distribution of the desired documents, the device adapted to be supported between a carrier's forearm and his body, the device comprising:

a document support tray for accepting and retaining documents, wherein the tray has first and second ends, first and second edges, and a top and a bottom surface, wherein a longitudinal axis extends between the first and the second end;

an arm support attached to the tray, wherein the arm support is adapted to only partially engage the arm of a carrier and wherein the arm support is positioned adjacent to the bottom surface of the tray;

a repellant holder attached to the bottom surface of the tray for holding a repellant container, wherein the repellant holder is oriented in a direction generally perpendicular to the longitudinal axis of the tray;

a repellant container mounted within the repellant holder, wherein the container has a spray nozzle extending therefrom and wherein the spray nozzle extends from the repellant holder and beyond the second edge of the document support tray;

wherein the document receptacle is a basket suspended beneath the tray;

further including a document receptacle extending at least partially below the bottom surface of the tray;

wherein the document receptacle is a basket suspended beneath the tray; and wherein the side wall has a document separator.

24. The device according to claim 23, wherein the separator is a stepped support, wherein the steps are spaced to space apart documents placed within the basket for ease of removal of such documents.

25. A device for carrying sets of documents of various sizes in such a manner to permit convenient access to the topmost documents and rapid, coordinated distribution of the desired documents, the device adapted to be supported between a carrier's forearm and his body, the device comprising:

a document support tray for accepting and retaining documents, wherein the tray has first and second ends, first and second edges, and a top and a bottom surface, wherein a longitudinal axis extends between the first and the second end;

an arm support attached to the tray, wherein the arm support is adapted to only partially engage the arm of a carrier and wherein the arm support is positioned adjacent to the bottom surface of the tray;

a repellant holder attached to the bottom surface of the tray for holding a repellant container, wherein the repellant holder is oriented in a direction generally perpendicular to the longitudinal axis of the tray;

a repellant container mounted within the repellant holder, wherein the container has a spray nozzle extending therefrom and wherein the spray nozzle extends from the repellant holder and beyond the second edge of the document support tray;

wherein the arm support is a frame attached to the tray and adapted to receive and rest against the arm of a carrier;

wherein the frame extends beyond the first edge of the tray and beyond the top surface of the tray, wherein the frame has a first support member with a shape extending away from the top surface of the tray and then extends in the direction from the first end to the second end of the tray and adapted to engage the arm of a carrier holding the device;

wherein the frame further includes a second support member extending from the first support member and adapted to enclose the arm of a carrier between the second support member and the first support member; and wherein the repellant holder is attached to the bottom surface of the tray through a third support member of the frame.

26. The device according to claim 25, wherein the third support member extends beyond the second edge and is oriented in a direction generally perpendicular to the longitudinal axis of the tray.

27. The device according to claim 25, further including a fourth support member extending from the third support member in a direction from the bottom surface of the tray to the top surface of the tray and generally perpendicular to the plane of the top surface.

28. The device according to claim 27, further including an umbrella secured by the fourth support member.

29. The device according to claim 27, further including a document holder secured by the fourth support surface.

30. The device according to claim 29, wherein the document holder has an angled separator therein to space apart at by increasing height different documents placed within the holder.

31. The device according to claim 27, further including a clamp secured by the fourth support member.

32. A device for carrying sets of documents of various sizes in such a manner to permit convenient access to the topmost documents and rapid, coordinated distribution of the desired documents, the device adapted to be supported between a carrier's forearm and his body, the structure comprising:

a document support tray for accepting and retaining documents, wherein the tray has first and second ends, first and second edges and a top and a bottom surface, wherein a longitudinal axis extends between the first and the second end;

an arm support attached to the tray, wherein the arm support is adapted to only partially engage the forearm of a carrier and wherein the arm support is positioned adjacent to the bottom surface of the tray;

a repellant holder attached to the bottom surface of the tray for holding a repellant container, wherein the repellant holder is oriented in a direction generally perpendicular to the longitudinal axis of the tray and wherein the repellant holder extends beyond the second edge of the tray; and a document receptacle extending at least partially below the bottom surface of the tray, wherein the document receptacle is a basket suspended beneath the tray; and a repellant container mounted within the repellant holder, wherein the container has a spray nozzle extending from the repellant holder and beyond the second edge of the document support tray.

33. A device for carrying sets of documents of various sizes in such a manner to permit convenient access to the topmost documents and rapid, coordinated distribution of the desired documents, the device adapted to be supported between a carrier's forearm and his body, the device comprising:

a document support tray for accepting and retaining documents, wherein the tray has first and second ends, first and second edges, and a top and a bottom surface, wherein a longitudinal axis extends between the first and the second end;

an arm support attached to the tray, wherein the arm support is adapted to at least partially engage the arm of a carrier and wherein the arm support is positioned adjacent to the bottom surface of the tray;

a repellant holder attached to the tray for holding a repellant container;

a document receptacle extending at least partially below the bottom surface of the tray, wherein the document receptacle is a basket suspended beneath the tray, wherein the basket has a side wall toward the second end of the tray to retain documents within the basket, and wherein the side wall has a document separator, wherein the separator is a stepped support; and wherein the steps are spaced to space apart documents placed within the basket for ease of removal of such documents.

34. A device for carrying sets of documents of various sizes in such a manner to permit convenient access to the topmost documents and rapid, coordinated distribution of the desired documents, the device adapted to be supported between a carrier's forearm and his body, the device comprising:

a document support tray for accepting and retaining documents, wherein the tray has first and second ends, first and second edges, and a top and a bottom surface, wherein a longitudinal axis extends between the first and the second end;

an arm support attached to the tray, wherein the arm support is adapted to at least partially engage the arm of a carrier and wherein the arm support is positioned adjacent to the bottom surface of the tray;

a repellant holder attached to the tray for holding a repellant container;

wherein the arm support is a frame attached to the tray and adapted to receive and rest against the arm of a carrier, wherein the frame extends beyond the first edge of the tray and beyond the top surface of the tray, wherein the frame has a first support member with a shape extending away from the top surface of the tray and then extending in the direction from the first end to the second end of the tray and adapted to engage the arm of a carrier holding the device, wherein the frame further includes a second support member extending from the first support member and adapted to enclose the arm of a carrier between the second support member and the first support member; and wherein the repellant holder is attached to the bottom surface of the tray through a third support member of the frame.

* * * * *

UNITED STATES PATENT AND TRADEMARK OFFICE

CERTIFICATE OF CORRECTION

PATENT NO. : 8,328,056 B2
APPLICATION NO. : 11/170780
DATED : December 11, 2012
INVENTOR(S) : David E. Berdych It is certified that error appears in the above-identified patent and that said Letters Patent is hereby corrected as shown below:

Column 7, Line 27, Claim 2, after "edges" insert -- , --

Column 7, Line 45, Claim 3, "claim 1," should read -- claim 2, --

Column 7, Line 48, Claim 4, "claim 2," should read -- claim 3, --

Column 7, Line 50, Claim 5, "claim 1," should read -- claim 2, --

Column 7, Line 57, Claim 7, "claim 1," should read -- claim 2, --

Column 8, Line 1, Claim 10, "claim 1," should read -- claim 2, --

Column 8, Line 23, Claim 17, "claim 1," should read -- claim 2, --

Column 10, Line 15, Claim 32, after "edges" insert -- , --

Signed and Sealed this
Twenty-sixth Day of February, 2013

Teresa Stanek Rea

Teresa Stanek Rea
*Acting Director of the United States Patent and Trademark Office*